US009637990B2

(12) United States Patent
Hill et al.

(10) Patent No.: US 9,637,990 B2
(45) Date of Patent: May 2, 2017

(54) PROPELLANT BACK OFF TOOL

(71) Applicant: HALLIBURTON ENERGY SERVICES, INC., Houston, TX (US)

(72) Inventors: Jim Taylor Hill, Kingwood, TX (US); Wesley N. Ludwig, Fort Worth, TX (US)

( * ) Notice: Subject to any disclaimer, the term of this patent is extended or adjusted under 35 U.S.C. 154(b) by 0 days.

(21) Appl. No.: 14/893,558

(22) PCT Filed: Jul. 14, 2014

(86) PCT No.: PCT/US2014/046494
§ 371 (c)(1),
(2) Date: Nov. 24, 2015

(87) PCT Pub. No.: WO2016/010510
PCT Pub. Date: Jan. 21, 2016

(65) Prior Publication Data
US 2016/0177648 A1 Jun. 23, 2016

(51) Int. Cl.
*E21B 31/107* (2006.01)
*E21B 23/04* (2006.01)

(52) U.S. Cl.
CPC ..... *E21B 31/1075* (2013.01); *E21B 23/04* (2013.01); *E21B 31/107* (2013.01)

(58) Field of Classification Search
CPC ..... E21B 31/1075; E21B 23/04; E21B 31/107
See application file for complete search history.

(56) References Cited

U.S. PATENT DOCUMENTS 798,310 A 8/1905 Wesson
2,725,820 A * 12/1955 McCullough ..... E21B 31/1075 102/322
2,745,345 A * 5/1956 Sweetman ..... E21B 31/1075 166/63

(Continued)

OTHER PUBLICATIONS

International Searching Authority, International Search Report and Written Opinion, International Application No. PCT/US2014/046494, which is a parent PCT to the instant application, Apr. 14, 2015.

(Continued)

*Primary Examiner* — Blake Michener
(74) *Attorney, Agent, or Firm* — Howard L. Speight, PLLC

(57) ABSTRACT

An apparatus includes a propellant chamber, an expansion chamber, an exit chamber comprising a port providing fluid communication outside the apparatus, and a longitudinal acceleration chamber. The longitudinal acceleration chamber includes a first end in fluid communication with the propellant chamber, a second end in fluid communication with the expansion chamber, and a longitudinal axis between the first end and the second end. An acceleration mass is slidably contained in the acceleration chamber. The acceleration chamber includes a propellant side between the propellant chamber and the acceleration mass, and a target side between the acceleration mass and the expansion chamber. A transfer piston is slidably positioned between the expansion chamber and the exit chamber. The transfer piston includes a first end projecting into the expansion chamber and aligned with the longitudinal axis of the acceleration chamber, and a second end projecting into the exit chamber.

20 Claims, 5 Drawing Sheets

(56) References Cited

U.S. PATENT DOCUMENTS

| | | | | |
|---|---|---|---|---|
| 3,199,594 | A * | 8/1965 | Kinley | E21B 31/1075 166/113 |
| 3,695,116 | A | 10/1972 | Baur | |
| 4,007,790 | A * | 2/1977 | Henning | E21B 31/1075 166/178 |
| 4,099,818 | A | 7/1978 | Meinzer | |
| 4,537,255 | A | 8/1985 | Regalbuto et al. | |
| 7,363,860 | B2 | 4/2008 | Wilson et al. | |
| 8,276,660 | B2 | 10/2012 | Bolze | |
| 2002/0162662 | A1 | 11/2002 | Passamaneck et al. | |
| 2005/0126783 | A1 | 6/2005 | Grattan et al. | |
| 2011/0174504 | A1 * | 7/2011 | Wright | E21B 23/04 166/386 |
| 2012/0111217 | A1 | 5/2012 | Bell | |
| 2013/0092378 | A1 | 4/2013 | Mhaskar et al. | |
| 2013/0248184 | A1 | 9/2013 | Glenn et al. | |
| 2013/0284453 | A1 * | 10/2013 | Vick, Jr. | E21B 34/06 166/373 |

OTHER PUBLICATIONS

Mark Cline, Gene Granger, Jean-Michel Hache, Jack Lands, Backoff Basics, Stuck Pipe, Oilfield Review, Oct. 1991.

Reusable Shock Tube Initiator, RISI, STI-8 Non-Explosive Shock Tube Initiator, http://www.teledynerisi.com/productpdf/page33.pdf, retrieved from the internet on Nov. 22, 2015 and filed herewith.

* cited by examiner

PROPELLANT BACK OFF TOOL

BACKGROUND

Drilling a well to produce hydrocarbons typically involves the use of well tubulars, such as casing, tubing, drill pipe or drill collars. Occasionally, such well tubulars become stuck downhole and a "back off" procedure is performed. Typically, such a procedure involves the use of an explosive device, such as a "string shot tool." A conventional string shot tool uses a measured length of detonating cord (a secondary explosive available in a rope-like form) to provide explosively generated concussion (shock) to a tubular connection allowing that connection to be decoupled, the connection torque released, and the pipe above to be recovered from the depth of the string shot.

Conventionally, a string shot tool also requires an explosive initiator for ignition. The initiator can contain primary or secondary explosives and may be qualified as Radio Frequency (RF) Safe, Stray Voltage (SV) Safe or a RF-SV safe initiator. Explosives are often regulated and controlled and require special procedures for import, storage, transport and handling in many countries.

DETAILED DESCRIPTION

Figure 1:
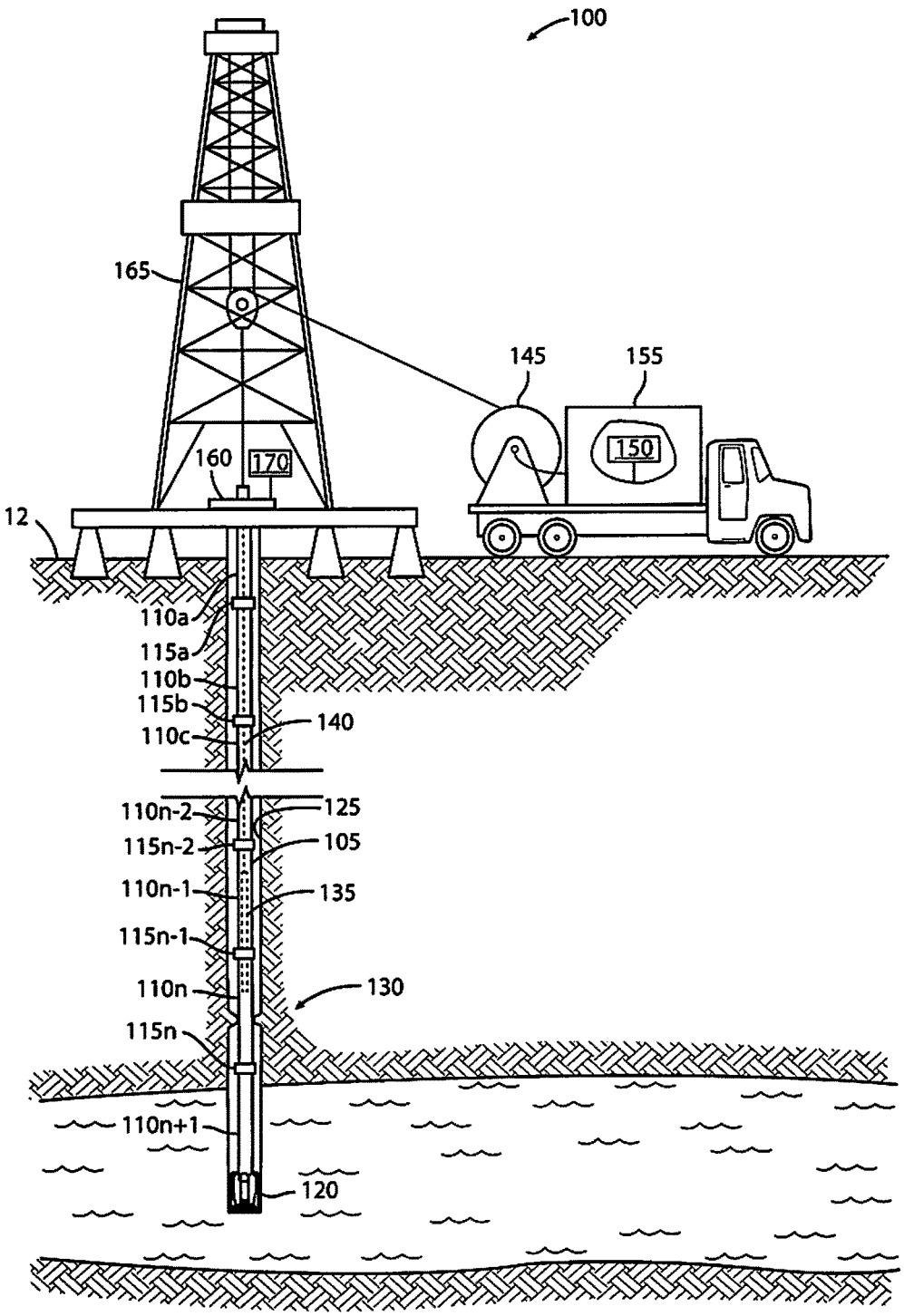
FIG. 1 is a schematic diagram of a pipe recovery system performing a back off procedure incorporating aspects of the present disclosure.

While this disclosure describes a pipe recovery system, it will be understood that the equipment and techniques described herein are applicable in drilling system environment, a measurement while drilling ("MWD")/logging while drilling ("LWD") environment, a wired drillpipe environment, a coiled tubing (wired and unwired) environment, and a wireline environment. Further, while the equipment and techniques described herein are shown in a land-based environment, it will be understood that they are applicable in a subsea or offshore environment. In one or more embodiments of a pipe recovery system 100, illustrated in FIG. 1, a well tubular 105, such as casing, tubing, drill pipe or drill collars, includes joints of tubular 110*a*-110*n*+1, such as drill pipe, coupled by threaded connections 115*a*-115*n*. In one or more embodiments, a bit 120 is at the deepest end of the well tubular 105. In the example shown in FIG. 1, the well tubular 105 has become stuck in a borehole 125 as the result of a collapse 130 in the borehole 125 between connection 115*n*−1 and connection 115*n*. In one or more embodiments, a back off procedure is initiated to recover the joints of tubular 110*a*-110*n*−1 above the connection 115*n*−1, which is located immediately above the collapse 130. In one or more embodiments, other techniques, such as fishing, will be used to recover the equipment below connection 115*n*−1.

In one or more embodiments, a pipe back off assembly 135 is lowered into the borehole 125 by a cable 140 that passes through the well tubular 105, through a spool 145 that allows the pipe back off assembly 135 to be raised and lowered within the borehole 125, and then to a control panel 150 (shown through a cutout) inside a truck 155. In one or more embodiments, the cable 140 provides mechanical support for the pipe back off assembly 135 within the borehole 125 and it also provides electrical connections by which the control panel 150 can activate the functions of the pipe back off assembly 135, as discussed in more detail below. In one or more embodiments, electrical power to activate these functions is provided by the control panel 150 and/or by a downhole controller (not shown) that is programmed to activate according to various control regimes (e.g., pressure, time, motion, etc.). In one or more embodiments, a rotary table control panel 170 controls the rotary table 160 that is part of the rig 165 being used to drill the borehole 125.

In one or more embodiments of a back off procedure, a driller uses the rotary table control panel 170 to cause the rotary table 160 to rotate the well tubular 105 in a direction to tighten the threads at each threaded connection 115*a*-115*n*−1 above the collapse 130. In one or more embodiments, the driller then uses the rotary table control panel 170 to cause the rotary table 160 to rotate the well tubular 105 in the opposite direction which puts unscrewing torque on each threaded connection 115*a*-115*n*−1 above the collapse 130. In one or more embodiments, the driller is careful not to over-torque the well tubular 105, which might cause one of the connections 115*a*-115*n*−1 above the collapse to break loose. When the unscrewing torque has been applied and the pipe back off assembly is properly located next to the connection 115*n*−1 to be broken loose, in one embodiment, the pipe back off assembly 135 is activated, which imparts an impulse of energy to connection 115*n*−1 causing joint 110*n*−1 to uncouple from connection 115*n*−1. The pipe back off assembly 135, the joints 110*a*-110*n*−1, and the connections 115*a*-115*n*−2 can then be withdrawn from the borehole 125. A fishing operation can then be commenced to recover the remaining tubular 110*n* and 110*n*+1 and the bit 120 from the borehole 125.

Figure 2:
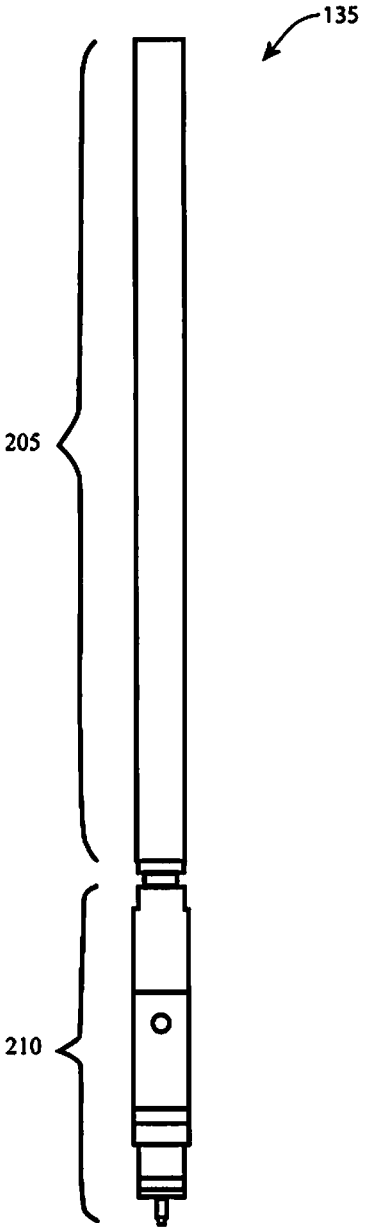
FIG. 2 is a schematic diagram of a pipe back off assembly in accordance with aspects of the present disclosure.

In one or more embodiments, illustrated in FIG. 2, the pipe back off assembly 135 includes a propellant assembly 205 where a detonating cord would normally be and a pipe back off tool 210. In one or more embodiments, the propellant assembly 205 includes a solid propellant formulated to provide very similar or identical concussive forces to those provided by a detonating cord conventionally used in a pipe back off tool. That is, in one or more embodiments, the propellant will supply the same energy as a conventional detonating cord but have a different time profile for providing the energy, as described below in connection with FIG. 4. In one or more embodiments, the propellant is subject to less extensive regulations, controls, and customs procedures as compared to the regulations, controls, and customs procedures for explosive materials mentioned above, making the propellant less expensive to use than an explosive.

Figure 3:
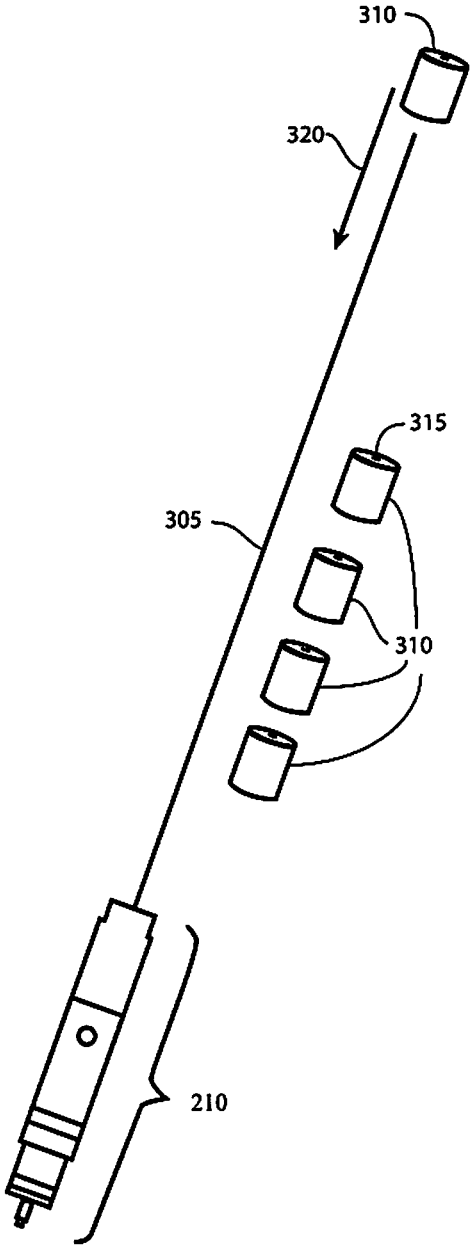
FIG. 3 is a schematic diagram of a pipe back off assembly showing the assembly of pellets of propellant into a propellant assembly in accordance with aspects of the present disclosure.

In one or more embodiments, illustrated in FIG. 3, the pipe back off tool 210 is a conventional string shot tool and the propellant assembly 205 includes a metal rod 305 that mounts to detonating cord mounting hardware (not shown) on the pipe back off tool 210 using conventional hardware. In one or more embodiments (not shown), the propellant is provided in stick or tube form. In one or more embodiments, the propellant is sized to provide a level of force appropriate for a tubular applications covering a range of pipe sizes, weights, grades and downhole forces. In one or more embodiments, shown in FIG. 3, the propellant is in the form of pellets 310 with a center orifice 315 (only one orifice 315 is labelled) allowing the pellets to be loaded onto metal rod 305 in the direction of the arrow 320 as shown in FIG. 3 with the metal rod 305 attaching to the pipe back off tool using the same detonating cord mounting hardware (not shown) as that used to attach conventional detonating cord to a conventional string shot tool. In one or more embodiments (not shown), solid pellets (i.e., pellets 310 without the center orifice 315) are loaded into the propellant assembly 205 without the metal rod 305. In one embodiment (not shown), the pellets 310 (with the center orifice 315) are loaded into the propellant assembly 205 with detonating cord run through the center orifice 315 of each pellet 310 to initiate. In one or more embodiments, the propellant includes potassium perchlorate, or a propellant similar to potassium perchlorate, mixed with a binding agent such as epoxy, with the ratio of the propellant to the binding agent and the size (diameter, length, and orifice 315 size) and number of pellets 310 determining the level of force to be supplied by the propellant.

Figure 4:
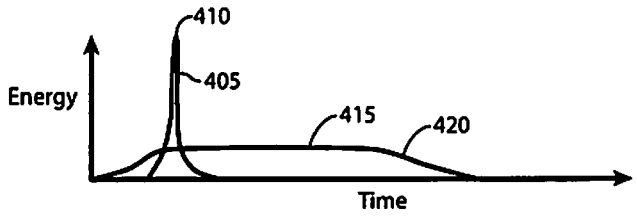
FIG. 4 is a graph showing the energy produced by an explosive versus that produced by a propellant over time in accordance with aspects of the present disclosure.

Conventionally, as mentioned above, back off is accomplished using detonation cord to explosively transfer energy into a select portion of the well tubular 105 to facilitate loosening of the nearby threaded connection, 115$n$−1. A propellant does not release energy as quickly as an explosive, so the peak energy transferred to the tubular will be less if the total explosive energy and the propellant energy are the same. This is illustrated in FIG. 4 where the energy, 405, produced by an explosive, such as a detonation cord, is similar in total quantity to the energy, 420, produced by a propellant. The energy 405 produced by the explosive has a higher peak 410 than the peak 415 of the energy 420 produced by a propellant. The propellant produces less peak energy than that produced by an explosive, but over a long period of time.

In one or more embodiments, a pipe back off tool delivers the energy produced by a propellant in a very short time to increase the peak level of energy transferred into the well tubular 105.

Figure 5:
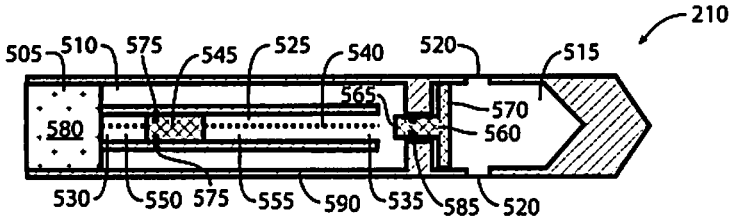
FIG. 5 is a cross sectional view of a pipe back off tool in accordance with aspects of the present disclosure.

In one or more embodiments, illustrated in FIG. 5, the pipe back off tool 210 comprises a propellant chamber 505, an expansion chamber 510, and an exit chamber 515. In one or more embodiments, the exit chamber 515 includes one or more ports 520 that provide fluid communication outside the apparatus. In one or more embodiments, the pipe back off tool 210 includes a longitudinal acceleration chamber 525 that includes a first end 530 in fluid communication with the propellant chamber 505, a second end 535 in fluid communication with the expansion chamber 510, and a longitudinal axis 540 between the first end 530 and the second end 535.

In one or more embodiments, the pipe back off tool 210 includes an acceleration mass 545 slidably contained in the acceleration chamber 525. In one or more embodiments, the acceleration chamber 525 includes a propellant side 550 between the propellant chamber 505 and the acceleration mass 545, and a target side 555 between the acceleration mass 545 and the expansion chamber 510. In one or more embodiments, the pipe back off tool 210 includes a transfer piston 560 slidably positioned between the expansion chamber 510 and the exit chamber 515. In one or more embodiments, the transfer piston 560 includes a first end 565 projecting into the expansion chamber 510 and aligned with the longitudinal axis 540 of the acceleration chamber 525. In one or more embodiments, the transfer piston 560 includes a second end 570 projecting into the exit chamber 515. In one or more embodiments, shear pins 575 hold the acceleration mass 545 in place in the acceleration chamber 525 until energy from ignition of a propellant 580 in the propellant chamber 505 is sufficient to break the shear pins 575. It will be understood that while two shear pins 575 are shown, the number of shear pins 575 used can be different (i.e., the number can be 1 or 3 or more). In one or more embodiments, the number of shear pins 575 is one of the elements that determines the amount of momentum the acceleration mass 545 will have when it strikes the transfer piston 560, as described below. In one or more embodiments, an o-ring or another sealing device (such as an elastomer seal or a combination elastomer seal that includes other sealing materials such as polyether ether ketone (PEEK), TEFLON® (provided by E.I. Du Pont de Nemours and Co. Corp.), or other similar materials) 585 provides a seal between the transfer piston 560 and a housing 590 for the pipe back off tool 210.

Figure 6:
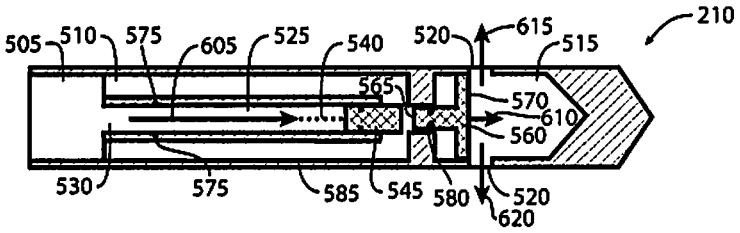
FIG. 6 is a cross sectional view of a pipe back off tool showing the results of actuation in accordance with aspects of the present disclosure.

FIG. 6 shows one embodiment of the pipe back off tool 210 after activation. In one or more embodiments, gasses from ignition of the propellant 580 (shown in FIG. 5 but not in FIG. 6) apply energy to the acceleration mass 545 until the shear pins 575 shear off. In one or more embodiments, the propellant gasses drive the acceleration mass 545 along the longitudinal axis 540 of the acceleration chamber 525 in the direction of arrow 605. In one or more embodiments, the acceleration of the acceleration mass 545 continues as long as the curve 415 (FIG. 4) is greater than zero or until the acceleration mass 545 strikes the first end 565 of the transfer piston 560, whichever occurs first. In one or more embodiments, the collision of the acceleration mass 545 with the first end 565 of the transfer piston 560 transfers the momentum of the acceleration mass 545 to the transfer piston 560, causing the transfer piston 560 to slide within the housing 585 and to project its second end 570 into the exit chamber 515, as indicated by arrow 610. In one or more embodiments, this projection causes fluid (typically drilling fluid) contained in the exit chamber 515 to be forcibly expelled from the exit chamber through ports 520, as indicated by arrows 615, 620. This sends a shockwave through fluid in the borehole 125 producing the desired impact on the well tubular 105.

In one or more embodiments, the dimensions of the pipe back off tool 210 and its components shown in FIGS. 5-9 vary with the size of the pipe back off assembly 135 that will fit into the well tubular 105. In one or more embodiments, it is desired to maximize the impact, i.e., energy transfer, to the well tubular 105 per unit time. In one or more embodiments, the propellant 580 will burn at a rate determined by the factors described above and produce the gas pressure driving the acceleration mass 545. The parameters of the transfer piston 560 (in particular, the material used and the dimensions of the first end 565 and the second end 570), the mass of the acceleration mass 545, and the length of the acceleration tube will determine the characteristics of the propellant 580. In general, in one embodiment, the goal is to size the acceleration mass 545 and acceleration chamber 525 to maximize the kinetic energy (E) imparted into the acceleration mass 545 by the propellant 580: $E=\frac{1}{2}mv^2$, where m is the mass of the acceleration mass 545 and v is the velocity of the acceleration mass 545 when it strikes the transfer piston 560. The area (A) of the acceleration mass 545 acted on by the gas expelled by the propellant 580 as it is consumed and the pressure (P) produced by the gas allows calculation of the force (F) acting on the piston: $F=P\cdot A$. In one or more embodiments, the gas pressure produced by the propellant 580 is a function of time, as shown in FIG. 4, and the volume it is confined in. In one or more embodiments, the volume is a function of the position of the acceleration mass 545 within the acceleration chamber 525; i.e., the volume increases as the acceleration mass 545 moves along the acceleration chamber 525 toward the transfer piston 560. In one or more embodiments, there is an optimal length for the acceleration chamber. If the acceleration chamber 525 is too short, the acceleration mass 545 will strike the transfer piston 560 before the propellant 580 is consumed and any remaining propellant 580 is wasted and might damage the tool. If the acceleration chamber 525 is too long, the propellant will be depleted before the acceleration mass 545 reaches the transfer piston and will lose energy due to friction thereafter.

In one or more embodiments, the propellant chamber 505, expansion chamber 510, and acceleration chamber 525 are sealed. When the acceleration mass 545 is accelerated along the acceleration chamber 525, the propellant side 550 volume gets larger and the target side 555 volume gets smaller. In one or more embodiments, the volume on the target side 555 is large enough that compression of the gas on the target side 555 does not impede acceleration of the acceleration mass 545. In one or more embodiments, the expansion chamber 510 is evacuated before running the pipe back off tool 210 in the borehole 125 to reduce this factor. Even if the chamber is evacuated, some gas is likely to leak around the acceleration mass 545 to the target side 555 before the acceleration mass 545 impacts with the transfer piston 560, so, in one embodiment, free volume is left in the expansion chamber 510 to avoid gas compression on the target side 555 from significantly reducing the momentum of the acceleration mass 545 at impact.

Another consideration is the area of the piston and target at the impact surface. Since the goal is to maximize the impact force in as short a time period as possible, in one or more embodiments this area is designed to transfer the energy with as little deformation as possible. Deformation of either the transfer piston 560 or the acceleration mass 545 will spread the energy transfer over a longer period of time. The other side of the transfer piston 560 transfers the energy of the mass to the fluid in the well and out to the well tubular 105. In one or more embodiments, the transfer piston 560, exit chamber 515, and ports 520 are designed to maximize the energy transfer out to the pipe.

In one or more embodiments, the design of the transfer piston 560 and the exit chamber 515 influence the optimal stiffness of the acceleration mass 545 and transfer piston 560. If the transfer piston 560 is required to move very far to accomplish the energy transfer, a driving force that builds over a short period of time is beneficial. In one or more embodiments, pulse shaping material is introduced between the acceleration mass 545 and the impact area on the first end 565 of the transfer piston 560 whose size, shape, and material properties are chosen to obtain the desired force profile. That is, in one or more embodiments, the material of the acceleration mass 545 and the transfer piston 560 are chosen to achieve the desired force profile. For example, in one or more embodiments, relatively hard materials will be used if a short pulse of force is desired. In one or more embodiments, softer materials will be used if a longer rise time on the pulse of force is desired. The hardness of the materials in the acceleration mass 545 and the transfer piston 560 contribute to a "hardness" factor in determining the force profile.

In one or more embodiments, another factor in the force profile produced by the pipe back off tool 210 are the shape of the face 705 (discussed below in connection with FIGS. 7-9) of the acceleration mass 545 and the shape of the first end 565 of the transfer piston 560. Assume for discussion purposes that the material of the transfer piston 560 and acceleration mass 545 are the same and have a given yield strength. If the shape of either one results in a point contact, the contact area will approach zero. The contact stress is equal to the contact force divided by the contact area. Thus, a point contact results in an infinite stress, which would exceed the finite yield strength of a real material. When the yield strength of the material is exceeded, energy is expended deforming the surface. This behavior will continue until the surfaces deform enough that the contact area can support the applied force. A necessary constraint for the surface area of a cone or other shape to deform and increase contact area is that the masses move closer together. The acceleration mass will have some finite velocity at initial contact, and the amount of movement to increase the surface area at contact from a point to a sufficient amount to transfer the peak force will take some time and involve transferring energy over that time period at a force less than the peak force.

Figure 7:
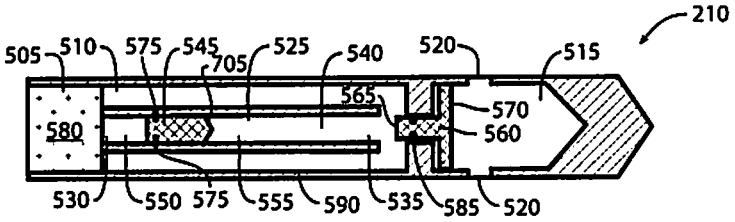
FIGS. 7-9 is a cross sectional view of a pipe back off tool showing various configurations of acceleration masses and transfer pistons in accordance with aspects of the present disclosure.
Figure 8:
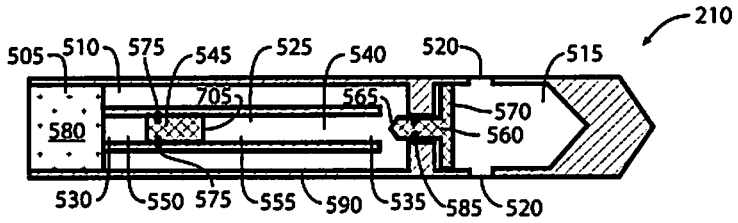
Figure 9:
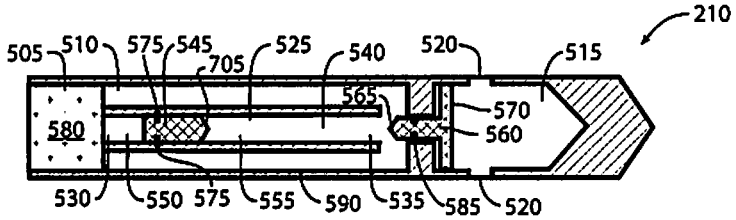

In one or more embodiments, if the peak force expected to be transferred is known, the transfer piston 560 and the acceleration mass can be designed so that the contact area between the two parts will support that force without plastic deformation of either part. If the surfaces are parallel at the instant of initial contact, then maximum force can be transmitted in as small a time period as possible with those materials. In one or more embodiment, the highest peak force is transferred when the face 705 of the acceleration mass 545 and the first end 530 of the transfer piston 560 are shaped such that they have sufficient area at the instant of contact so that there is no plastic deformation of either part. In one or more embodiments, other shapes other than a flat face are possible. In one or more embodiments, a 'male' cone could be machined onto the face of one part and 'female' cone machined into the other, or a ball shape on one part and a matching ball socket shape on the other part, to achieve the same result. In one or more embodiments, illustrated in FIG. 7, the face 705 of the acceleration mass 545 that faces the target side 555 of the acceleration chamber 525 has a substantially conical shape, where a shape is substantially conical when the shape deviates from the shape of an ideal right cone having a height corresponding to the maximum height of the shape and a radius corresponding to the maximum radius of the shape (where the maximum height and maximum radius of the shape are measured in orthogonal directions) by less than a deviation percentage at any point on the shape and where the deviation percentage is 10 percent in one or more embodiments, 25 percent in one or more embodiments, and 35 percent in one or more embodiments. In one or more embodiments, illustrated in FIG. 8, the face of the first end 565 of the transfer piston 565 has a substantially conical shape. In one or more embodiments, illustrated in FIG. 9, both the face 705 of the acceleration mass 545 and the face of the first end 565 of the transfer piston 565 have substantially conical shapes. In one or more embodiments (not shown), one or more of the conical shapes described in reference to FIGS. 7-9 are truncated cones, i.e., the pointed end of the cone is flattened or rounded. In another example, in one or more embodiments, the acceleration mass 545 and the transfer piston 560 are designed to contact over their respective faces, as shown in FIGS. 5 and 6, which may slow the transfer of energy depending on the degree to which the respective faces are parallel to each other. In one or more embodiments, this "contact profile" factor is balanced with the hardness factor described above to produce the desired force profile.

In one or more embodiments (not shown), the acceleration mass 545 transfers its momentum to one or more hammers (not shown) that mechanically transfer energy into the well tubular 105.

Figure 10:
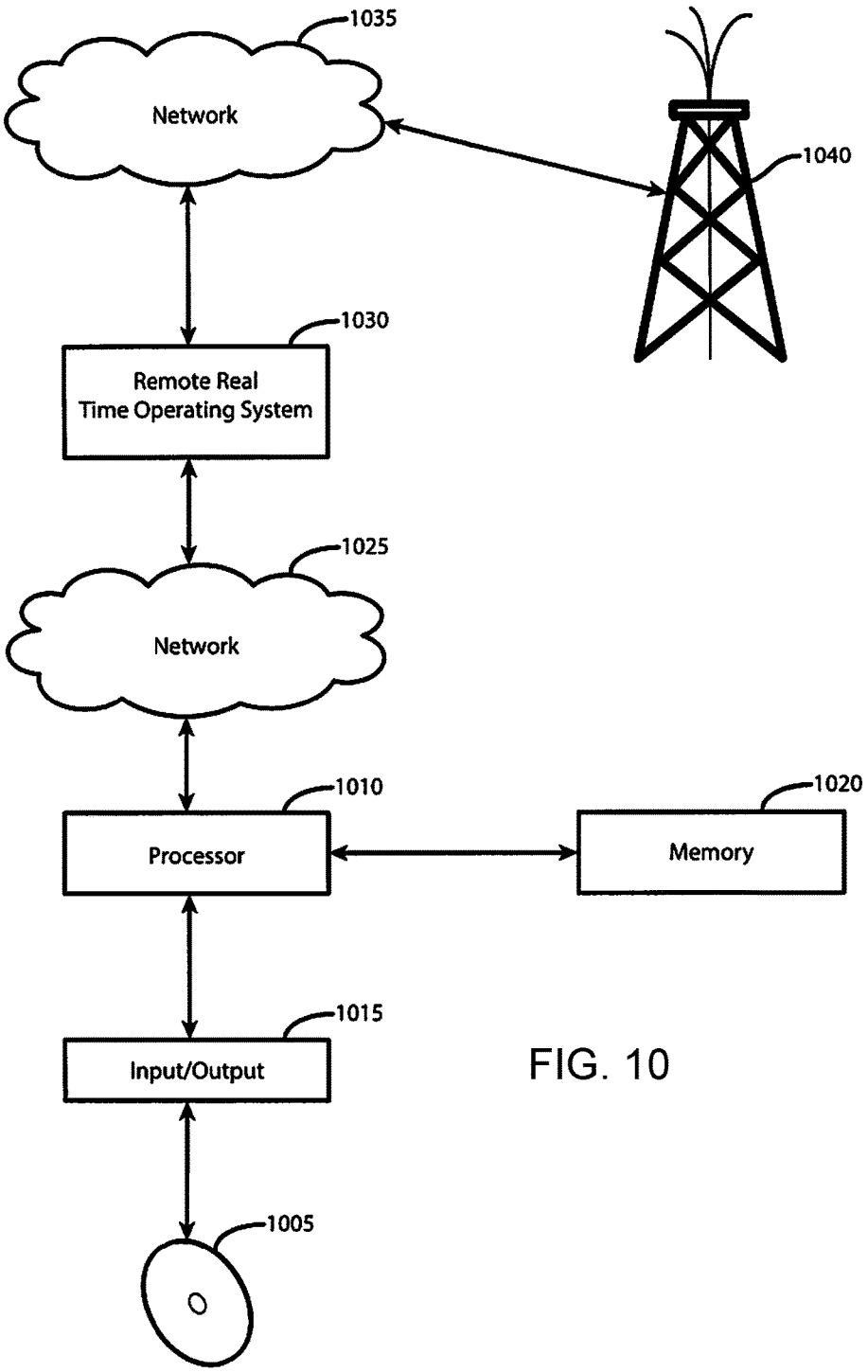
FIG. 10 is a schematic of an environment showing command and control information flow.

In one or more embodiments, shown in FIG. 10, the pipe back off tool 210 is controlled by software in the form of a computer program on a non-transitory computer readable media 1005, such as a CD, a DVD, a USB drive, a portable hard drive or other portable memory. In one or more embodiments, a processor 1010, which may be the same as or included in the control panel 150, reads the computer program from the computer readable media 1005 through an input/output device 1015 and stores it in a memory 1020 where it is prepared for execution through compiling and linking, if necessary, and then executed. In one or more embodiments, the system accepts inputs through an input/output device 1015, such as a keyboard or keypad, mouse, touchpad, touch screen, etc., and provides outputs through an input/output device 1015, such as a monitor or printer. In one or more embodiments, the system stores the results of calculations in memory 1020 or modifies such calculations that already exist in memory 1020.

In one or more embodiments, the results of calculations that reside in memory 1020 are made available through a network 1025 to a remote real time operating center 1030. In one or more embodiments, the remote real time operating center 1030 makes the results of calculations available through a network 1035 to help in the planning of oil wells 1040 or in the drilling of oil wells 1040.

References in the specification to "one or more embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Embodiments of the invention include features, methods or processes that may be embodied within machine-executable instructions provided by a machine-readable medium. A computer-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a computer-readable medium includes non-transitory volatile and/or non-volatile media (e.g., read only memory (ROM), random access memory (RAM), magnetic disk storage media, optical storage media, flash memory devices, etc.), as well as transitory electrical, optical, acoustical or other form of propagated signals (e.g., carrier waves, infrared signals, digital signals, etc.).

Such instructions are utilized to cause a general or special purpose processor, programmed with the instructions, to perform methods or processes of the embodiments of the invention. Alternatively, the features or operations of embodiments of the invention are performed by specific hardware components which contain hard-wired logic for performing the operations, or by any combination of programmed data processing components and specific hardware components. One or more embodiments of the invention include software, data processing hardware, data processing system-implemented methods, and various processing operations, further described herein.

One or more figures show block diagrams of systems and apparatus for a system for monitoring hookload, in accordance with one or more embodiments of the invention. One or more figures show flow diagrams illustrating operations for monitoring hookload, in accordance with one or more embodiments of the invention. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

An apparatus includes a propellant chamber, an expansion chamber and an exit chamber including a port providing fluid communication outside the apparatus. The apparatus includes a longitudinal acceleration chamber, which includes a first end in fluid communication with the propellant chamber, a second end in fluid communication with the expansion chamber, and a longitudinal axis between the first end and the second end. An acceleration mass is slidably contained in the acceleration chamber. The acceleration chamber includes a propellant side between the propellant chamber and the acceleration mass and a target side between the acceleration mass and the expansion chamber. A transfer piston is slidably positioned between the expansion chamber and the exit chamber. The transfer piston includes a first end projecting into the expansion chamber and aligned with the longitudinal axis of the acceleration chamber and a second end projecting into the exit chamber.

Implementations of the apparatus may include one or more of the following. The propellant chamber may contain a propellant. The propellant chamber may include a propellant including potassium perchlorate. The transfer piston may have a longitudinal axis substantially parallel to the longitudinal axis of the acceleration chamber. A cross section of the first end perpendicular to the longitudinal axis of the transfer piston may be smaller than a cross section of the second end perpendicular to the longitudinal axis of the transfer petition. The acceleration mass may include a target face facing the target side of the acceleration chamber. The target face may not be flat. The target face may include a feature having a substantially conical shape. The target face may include a feature having a substantially a shape of a truncated cone. The first end of the transfer piston may include a feature having a substantially conical shape. The first end of the transfer piston may include a feature having a substantially a shape of a truncated cone. The propellant, the acceleration mass, and the acceleration chamber may be selected such that the acceleration mass will strike the transfer piston as the propellant is finished burning.

A method includes constructing a pipe back off assembly including a propellant chamber containing a propellant, an expansion chamber, and an exit chamber comprising a port providing fluid communication outside the apparatus. The pipe back off assembly is constructed to include a longitudinal acceleration chamber. The longitudinal acceleration chamber includes a first end in fluid communication with the propellant chamber, a second end in fluid communication with the expansion chamber, and a longitudinal axis between the first end and the second end. The pipe back off assembly is constructed to include an acceleration mass. The acceleration mass is slidably contained in the acceleration chamber. The acceleration chamber includes a propellant side between the propellant chamber and the acceleration mass and a target side between the acceleration mass and the expansion chamber. The pipe back off assembly is constructed to include a transfer piston slidably positioned between the expansion chamber and the exit chamber. The transfer piston includes a first end projecting into the expansion chamber and aligned with the longitudinal axis of the acceleration chamber, and a second end projecting into the exit chamber. The method further includes igniting the propellant, causing the acceleration mass to accelerate along the longitudinal axis of the acceleration chamber and to strike the first end of the transfer piston, causing the second end of the transfer piston to project into the exit chamber, causing a fluid contained in the exit chamber to be expelled from the exit chamber.

Implementations of the method may include one or more of the following. Accelerating the acceleration mass may cause the acceleration mass to gain momentum. The acceleration mass may transfer a portion of its momentum to the transfer piston. The method may further include selecting the propellant, the acceleration mass, and the acceleration chamber such that the acceleration mass will strike the transfer piston as the propellant is finished burning.

A system includes a control panel, a cable coupled to the control panel, a pipe back off assembly coupled to the cable. The pipe back off assembly includes a propellant assembly and a pipe back off tool. The pipe back off tool includes a propellant chamber coupled to the propellant assembly, an expansion chamber, an exit chamber comprising a port providing fluid communication outside the apparatus. The pipe back off tool further includes a longitudinal acceleration chamber. The longitudinal acceleration chamber includes a first end in fluid communication with the propellant chamber, a second end in fluid communication with the expansion chamber, and a longitudinal axis between the first end and the second end. The pipe back off tool further includes an acceleration mass slidably contained in an acceleration chamber. The acceleration chamber includes a propellant side between the propellant chamber and the acceleration mass and a target side between the acceleration mass and the expansion chamber. The pipe back off tool further includes a transfer piston slidably positioned between the expansion chamber and the exit chamber. The transfer piston includes a first end projecting into the expansion chamber and aligned with the longitudinal axis of the acceleration chamber, and a second end projecting into the exit chamber.

Implementations of the system may include one or more of the following. The propellant chamber may contain a propellant. The propellant chamber may contain a propellant which may include potassium perchlorate. The transfer piston may have a longitudinal axis substantially parallel to the longitudinal axis of the acceleration chamber. A cross section of the first end perpendicular to the longitudinal axis of the transfer piston may be smaller than a cross section of the second end perpendicular to the longitudinal axis of the transfer petition. The acceleration mass may include a target face facing the target side of the acceleration chamber. The target face may not be flat. The target face may include a feature having a substantially conical shape. The target face may include a feature having substantially a shape of a truncated cone. The first end of the transfer piston may include a feature having a substantially conical shape. The first end of the transfer piston may include a feature having substantially a shape of a truncated cone. The propellant, the acceleration mass, and the acceleration chamber may be selected such that the acceleration mass will strike the transfer piston as the propellant is finished burning. The system may include a non-transitory computer-readable medium on which is recorded a computer program. The program may include executable instructions, that, when executed, cause a processor in the control panel to perform a method. The method may include igniting a propellant in the propellant chamber, causing the acceleration mass to accelerate along the longitudinal axis of the acceleration chamber and to strike the first end of the transfer piston, causing the second end of the transfer piston to project into the exit chamber, causing a fluid contained in the exit chamber to be expelled from the exit chamber.

An apparatus includes a string shot tool. The string shot tool includes a detonating cord accepting hardware and a propellant coupled to the detonating-cord-accepting hardware.

Implementations of the apparatus may include one or more of the following. The apparatus may include a rod coupled to the detonating-cord-accepting hardware. The propellant may be mountable on the rod by use of an orifice through the propellant. The propellant may be formed into a plurality of pellets with orifices therethrough. The plurality of pellets may be mountable on the rod by use of the orifices. The propellant may be formed into a plurality of pellets with orifices therethrough and the plurality of pellets may be coupled to the detonating-cord-accepting hardware by a detonating cord running through the orifices of the plurality of pellets.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a pipe back off tool having:

a propellant chamber;

an expansion chamber;

an exit chamber comprising a port providing fluid communication outside the apparatus;

a longitudinal acceleration chamber having:
a first end in fluid communication with the propellant chamber,
a second end in fluid communication with the expansion chamber, and
a longitudinal axis between the first end and the second end;
an acceleration mass slidably contained in the acceleration chamber, wherein the acceleration chamber has:
a propellant sub-chamber between the propellant chamber and the acceleration mass, and
a target sub-chamber between the acceleration mass and the expansion chamber;
a transfer piston slidably positioned between the expansion chamber and the exit chamber, the transfer piston having:
a first end projecting into the expansion chamber and aligned with the longitudinal axis of the acceleration chamber wherein the first end of the transfer piston is separated from the acceleration mass prior to operation, and
a second end projecting into the exit chamber.

2. The apparatus of claim 1 wherein:
the propellant chamber contains a propellant.

3. The apparatus of claim 1 wherein:
the propellant chamber contains a propellant comprising potassium perchlorate.

4. The apparatus of claim 1 wherein:
the transfer piston has a longitudinal axis substantially parallel to the longitudinal axis of the acceleration chamber;
a cross section of the first end perpendicular to the longitudinal axis of the transfer piston is smaller than a cross section of the second end perpendicular to the longitudinal axis of the transfer petition.

5. The apparatus of claim 1 wherein:
the acceleration mass comprises a target face facing the target side of the acceleration chamber; and
the target face is not flat.

6. The apparatus of claim 5 wherein:
the target face comprises a feature having a substantially conical shape.

7. The apparatus of claim 5 wherein:
the first end of the transfer piston comprises a feature having a substantially conical shape.

8. The apparatus of claim 5, wherein the propellant, the acceleration mass, and the acceleration chamber are selected such that the acceleration mass will strike the transfer piston as the propellant is finished burning.

9. A method comprising:
constructing a pipe back off assembly having:
a propellant chamber containing a propellant;
an expansion chamber;
an exit chamber comprising a port providing fluid communication outside the apparatus;
a longitudinal acceleration chamber having:
a first end in fluid communication with the propellant chamber,
a second end in fluid communication with the expansion chamber, and
a longitudinal axis between the first end and the second end;
an acceleration mass slidably contained in the acceleration chamber, wherein the acceleration chamber has:
a propellant sub-chamber between the propellant chamber and the acceleration mass, and
a target sub-chamber between the acceleration mass and the expansion chamber;
a transfer piston slidably positioned between the expansion chamber and the exit chamber, the transfer piston having:
a first end projecting into the expansion chamber and aligned with the longitudinal axis of the acceleration chamber, and
a second end projecting into the exit chamber;
igniting the propellant, causing:
the acceleration mass to accelerate along the longitudinal axis of the acceleration chamber and to strike the first end of the transfer piston, causing:
the second end of the transfer piston to project into the exit chamber, causing:
a fluid contained in the exit chamber to be expelled from the exit chamber.

10. The method of claim 9 wherein accelerating the acceleration mass causes the acceleration mass to gain momentum and the method further comprises the acceleration mass transferring a portion of its momentum to the transfer piston.

11. The method of claim 9, further comprising selecting the propellant, the acceleration mass, and the acceleration chamber such that the acceleration mass will strike the transfer piston as the propellant is finished burning.

12. A system comprising:
a control panel;
a cable coupled to the control panel;
a pipe back off assembly coupled to the cable, the pipe back off assembly comprising:
a propellant assembly, and
a pipe back off tool having:
a propellant chamber coupled to the propellant assembly;
an expansion chamber;
an exit chamber comprising a port providing fluid communication outside the apparatus;
a longitudinal acceleration chamber having:
a first end in fluid communication with the propellant chamber,
a second end in fluid communication with the expansion chamber, and
a longitudinal axis between the first end and the second end;
an acceleration mass slidably contained in an acceleration chamber, wherein the acceleration chamber has:
a propellant sub-chamber between the propellant chamber and the acceleration mass, and
a target sub-chamber between the acceleration mass and the expansion chamber;
a transfer piston slidably positioned between the expansion chamber and the exit chamber, the transfer piston having:
a first end projecting into the expansion chamber and aligned with the longitudinal axis of the acceleration chamber, and
a second end projecting into the exit chamber.

13. The system of claim 12 wherein:
the propellant chamber contains a propellant.

14. The system of claim 12 wherein:
the propellant chamber contains a propellant comprising potassium perchlorate.

15. The system of claim 12 wherein:

the transfer piston has a longitudinal axis substantially parallel to the longitudinal axis of the acceleration chamber;

a cross section of the first end perpendicular to the longitudinal axis of the transfer piston is smaller than a cross section of the second end perpendicular to the longitudinal axis of the transfer petition.

16. The system of claim 12 wherein:

the acceleration mass comprises a target face facing the target side of the acceleration chamber; and the target face is not flat.

17. The system of claim 16 wherein:

the target face comprises a feature having a substantially conical shape.

18. The system of claim 16 wherein:

the first end of the transfer piston comprises a feature having a substantially conical shape.

19. The system of claim 16, wherein the propellant, the acceleration mass, and the acceleration chamber are selected such that the acceleration mass will strike the transfer piston as the propellant is finished burning.

20. The system of claim 12 further comprising:

a-non-transitory computer-readable medium on which is recorded a computer program, the program comprising executable instructions, that, when executed, cause a processor in the control panel to perform a method comprising:

igniting a propellant in the propellant chamber, causing:

the acceleration mass to accelerate along the longitudinal axis of the acceleration chamber and to strike the first end of the transfer piston, causing:

the second end of the transfer piston to project into the exit chamber, causing:

a fluid contained in the exit chamber to be expelled from the exit chamber.

* * * * *